US011391301B2

(12) United States Patent
Portolese et al.

(10) Patent No.: US 11,391,301 B2
(45) Date of Patent: Jul. 19, 2022

(54) ELECTROHYDRAULIC POPPET VALVE DEVICE CONTROL THAT MAINTAINS THE LAST COMMANDED POSITION OF A DEVICE UPON POWER INTERRUPTION AND PROVIDES BACK-UP POSITION CONTROL

(71) Applicant: HONEYWELL INTERNATIONAL INC., Morris Plains, NJ (US)

(72) Inventors: Larry A. Portolese, Granger, IN (US); Matthew Arend, South Bend, IN (US); Paul Futa, North Liberty, IN (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 9 days.

(21) Appl. No.: 16/848,377

(22) Filed: Apr. 14, 2020

(65) Prior Publication Data

US 2021/0317851 A1 Oct. 14, 2021

(51) Int. Cl.
*F15B 13/043* (2006.01)
*F15B 11/00* (2006.01)
*F15B 13/04* (2006.01)

(52) U.S. Cl.
CPC ..... *F15B 11/006* (2013.01); *F15B 13/0405* (2013.01); *F15B 13/0436* (2013.01)

(58) Field of Classification Search
CPC . F15B 13/0436; F15B 11/006; F15B 13/0405
See application file for complete search history.

(56) References Cited

U.S. PATENT DOCUMENTS 3,922,955 A * 12/1975 Kast ..... F15B 11/128 91/461
4,276,809 A 7/1981 Kast
4,378,031 A * 3/1983 Nicholson ..... F15B 13/0436 137/625.63
5,975,134 A * 11/1999 Schwelm ..... F15B 13/086 137/596.15
7,475,537 B2 1/2009 Spickard
9,328,839 B2 * 5/2016 Arend ..... F16K 31/0679

* cited by examiner

*Primary Examiner* — F Daniel Lopez
(74) *Attorney, Agent, or Firm* — Lorenz & Kopf, LLP

(57) ABSTRACT

An electrohydraulic poppet valve device control system includes a main body, an extend poppet valve, a retract valve body, a retract poppet valve, and an actuator. The actuator is movable to an extend position, a retract position, and a null position, and moves to, or remains in, the null position when electrical power is not supplied to the actuator. In the extend position, the extend poppet valve is in its open position and the retract poppet valve is in its closed position. In the retract position, the extend poppet valve is in its closed position and the retract poppet valve is in its open position. In the null position, the extend poppet valve is in its closed position and the retract poppet valve is in its closed position.

17 Claims, 13 Drawing Sheets

ELECTROHYDRAULIC POPPET VALVE DEVICE CONTROL THAT MAINTAINS THE LAST COMMANDED POSITION OF A DEVICE UPON POWER INTERRUPTION AND PROVIDES BACK-UP POSITION CONTROL

TECHNICAL FIELD

The present disclosure generally relates to devices controlled by electrohydraulic valves and more particularly relates to a system that, upon power interruption, maintains the last commanded position of a device that is controlled by an electrohydraulic poppet valve device control, and provides back-up position control of that device.

BACKGROUND

The position of a controlled device, such as an actuator or a valve, may be either electrically controlled, via a motor, or hydraulically controlled, via an electrohydraulic servo valve arrangement. Depending on the particular end-use environment of the device, it may be desirable to maintain the device in the last commanded position (i.e., "fail-fixed") in the unlikely event of a power interruption. For example, many fuel metering valves that control fuel flow to gas turbine propulsion engines are required to maintain the last commanded position in the unlikely event of a power interruption. As another example, many engines that include compressor inlet guide vanes also include a requirement that the guide vanes remain in the last commanded position in the unlikely event of a power interruption. A need also exists for back-up position control of these devices.

The fail-fixed functionality for many fuel metering valves is implemented using a stepper motor. Although stepper motors are robust and reliable, these devices can exhibit certain drawbacks. For example, stepper motors can draw relatively high electrical power from the associated controller. Moreover, for electrical redundancy, a second stepper motor and a summing gearbox may also be needed, which results in increased weight of the control, cabling, and engine. Some stepper motors also provide a relatively low force output, which may limit continued operability in environments where contaminated fuel is possible. Additionally, stepper motor driven metering valves are not easily adaptable for back-up position control.

For compressor inlet guide vanes, the fail-fixed functionality options are relatively limited. Stepper motors can be used but, when used, typically rely on relatively complicated mechanical feedback systems to ensure the actuator remains in the last commanded position. Other options include using a lockout valve that is activated by a solenoid or similar signal to hydraulically lock the actuator. This option, however, adds additional weight and complexity to the controller and engine, and are not easily adaptable for back-up position control.

Hence, there is a need for a system that maintains the last commanded position of a controlled device upon power interruption that adds little or no cost, little or no complexity, little or no size, and little or no weight to existing systems, and provides back-up position control of the device. The present invention addresses at least this need.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, an electrohydraulic poppet valve device control system includes a main body, an extend poppet valve, a retract poppet valve, and an actuator. The main body has an extend valve bore and a retract valve bore defined therein. The extend valve bore includes an extend valve inlet port, an extend valve outlet port, an extend valve control pressure port, and an extend valve return pressure port. The retract valve bore includes a retract valve inlet port, a retract valve outlet port, a retract valve control pressure port, and a retract valve return pressure port. The extend poppet valve is disposed within the extend valve bore and is movable therein between a closed position, in which the extend valve inlet port is fluidly isolated from the extend valve outlet port, and an open position, in which the extend valve inlet port is in fluid communication with the extend valve outlet port. The retract poppet valve is disposed within the retract valve bore and is movable therein between a closed position, in which the retract inlet port is fluidly isolated from the retract valve outlet port, and an open position, in which the retract inlet port is in fluid communication with the retract valve outlet port. The actuator includes an actuator supply pressure port, an actuator return pressure port, an extend control pressure port, and a retract control pressure port. The actuator return pressure port is in fluid communication with the extend valve return pressure port and the retract valve return pressure port. The extend control pressure port is in fluid communication with the extend valve control pressure port. The retract control pressure port is in fluid communication with the retract valve control pressure port. The actuator is movable to an extend position, a retract position, and a null position. In the extend position, the actuator supply pressure port is in fluid communication with the extend valve control pressure port and the actuator return pressure port is in fluid communication with the retract valve control pressure port, thereby causing the extend poppet valve to be in its open position and the retract poppet valve to be in its closed position. In the retract position, the actuator supply pressure port is in fluid communication with the retract valve control pressure port and the actuator return pressure port is in fluid communication with the extend valve control pressure port, thereby causing the extend poppet valve to be in its closed position and the retract poppet valve to be in its open position. In the null position, the actuator supply pressure port and the actuator return pressure port are fluidly coupled to both of the extend valve control pressure port and the retract valve control pressure port, thereby causing the extend poppet valve to be in its closed position and the retract poppet valve to be in its closed position. The actuator moves to, or remains in, the null position when electrical power is not supplied to the actuator.

In another embodiment, an electrohydraulic poppet valve device control system includes a main body, an extend poppet valve, a retract valve body, a retract poppet valve, an actuator, a device housing, and a device. The main body has an extend valve bore and a retract valve bore defined therein. The extend valve bore includes an extend valve inlet port, an extend valve outlet port, an extend valve control pressure port, and an extend valve return pressure port. The retract valve bore includes a retract valve inlet port, a retract valve outlet port, a retract valve control pressure port, and a retract valve return pressure port. The extend poppet valve is disposed within the extend valve bore and is movable therein between a closed position, in which the extend valve inlet port is fluidly isolated from the extend valve outlet port, and an open position, in which the extend valve inlet port is in fluid communication with the extend valve outlet port. The retract poppet valve is disposed within the retract valve bore and is movable therein between a closed position, in which the retract inlet port is fluidly isolated from the retract valve outlet port, and an open position, in which the retract inlet port is in fluid communication with the retract valve outlet port. The actuator includes an actuator supply pressure port, an actuator return pressure port, an extend control pressure port, a retract control pressure port, a jet tube, and a three-channel torque motor. The actuator return pressure port is in fluid communication with the extend valve return pressure port and the retract valve return pressure port. The extend control pressure port is in fluid communication with the extend valve control pressure port. The retract control pressure port is in fluid communication with the retract valve control pressure port. The jet tube is in fluid communication with the actuator supply pressure port and is movable to an extend position, a retract position, and a null position. The three-channel torque motor is coupled to the jet tube and responsive to commands to move the jet tube. The device housing has an inner surface, an outer surface, and at least one actuation control pressure port. The inner surface defes a device cavity, and the at least one actuation control pressure port is in fluid communication with the extend valve outlet port and the retract valve outlet port. The device is disposed at least partially in, and movable within, the device cavity. The device is movable in response to at least fluid pressure in the at least one actuation control pressure port. In the extend position, the actuator supply pressure port is in fluid communication with the extend valve control pressure port and the actuator return pressure port is in fluid communication with the retract valve control pressure port, thereby causing the extend poppet valve to be in its open position and the retract poppet valve to be in its closed position. In the retract position, the actuator supply pressure port is in fluid communication with the retract valve control pressure port and the actuator return pressure port is in fluid communication with the extend valve control pressure port, thereby causing the extend poppet valve to be in its closed position and the retract poppet valve to be in its open position. In the null position, the actuator supply pressure port and the actuator return pressure port are fluidly coupled to both of the extend valve control pressure port and the retract valve control pressure port, thereby causing the extend poppet valve to be in its closed position and the retract poppet valve to be in its closed position. The torque motor moves the jet tube to, or causes it to remain in, the null position when electrical power is not supplied to the torque motor.

In yet another embodiment, an electrohydraulic poppet valve device control system includes a main body, a first extend poppet valve, a second extend poppet valve, a first retract poppet valve, a second retract poppet valve, and an actuator. The main body has a first extend valve bore, a second extend valve bore, a first retract valve bore, and a second retract valve bore defined therein. The first extend valve bore includes a first extend valve inlet port, a first extend valve outlet port, first extend valve control pressure port, and a first extend valve return pressure port. The second extend valve bore includes a second extend valve inlet port, a second extend valve outlet port, second extend valve control pressure port, and a second extend valve return pressure port. The first retract valve bore includes a first retract valve inlet port, a first retract valve outlet port, a first retract valve control pressure port, and a first retract valve return pressure port. The second retract valve bore includes a second retract valve inlet port, a second retract valve outlet port, a second retract valve control pressure port, and a second retract valve return pressure port. The first extend poppet valve is disposed within the first extend valve bore and is movable therein between a closed position, in which the first extend valve inlet port is fluidly isolated from the first extend valve outlet port, and an open position, in which the first extend valve inlet port is in fluid communication with the first extend valve outlet port. The second extend poppet valve is disposed within the second extend valve bore and is movable therein between a closed position, in which the second extend valve inlet port is fluidly isolated from the second extend valve outlet port, and an open position, in which the second extend valve inlet port is in fluid communication with the second extend valve outlet port. The first retract poppet valve is disposed within the first retract valve bore and is movable therein between a closed position, in which the first retract inlet port is fluidly isolated from the first retract valve outlet port, and an open position, in which the first retract inlet port is in fluid communication with the first retract valve outlet port. The second retract poppet valve is disposed within the second retract valve bore and is movable therein between a closed position, in which the second retract inlet port is fluidly isolated from the second retract valve outlet port, and an open position, in which the second retract inlet port is in fluid communication with the second retract valve outlet port. The actuator includes an actuator supply pressure port, an actuator return pressure port, an extend control pressure port, and a retract control pressure port. The actuator return pressure port is in fluid communication with the extend valve return pressure port, the second extend valve return pressure port, the retract valve return pressure port, and the second retract valve return pressure port. The extend control pressure port is in fluid communication with extend valve control pressure port and the second extend valve control pressure port. The retract control pressure port is in fluid communication with retract valve control pressure port and the second retract valve control pressure port. The actuator is movable to an extend position, a retract position, and a null position. In the extend position, the actuator supply pressure port is in fluid communication with the first extend valve control pressure port and the second extend valve control pressure port, and the actuator return pressure port is in fluid communication with the first retract valve control pressure port and the second retract valve control pressure port, thereby causing the first and second extend poppet valves to be in open positions and the first and second retract poppet valve to be in closed positions. In the retract position, the actuator supply pressure port is in fluid communication with the first retract valve control pressure port and the second retract valve control pressure port, and the actuator return pressure port is in fluid communication with the first extend valve control pressure port and the second extend valve control pressure port, thereby causing the first and second extend poppet valves to be in closed positions and the first and second retract poppet valves to be in open position. In the null position, the actuator supply pressure port and the actuator return pressure port are fluidly coupled to both of the first extend valve control pressure port and the first retract valve control pressure port and from both of the second extend valve control pressure port and the second retract valve control pressure port, thereby causing the first and extend poppet valves and the first and second retract poppet valves to be in closed positions. The actuator moves to, or remains in, the null position when electrical power is not supplied to the actuator.

Furthermore, other desirable features and characteristics of the system will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
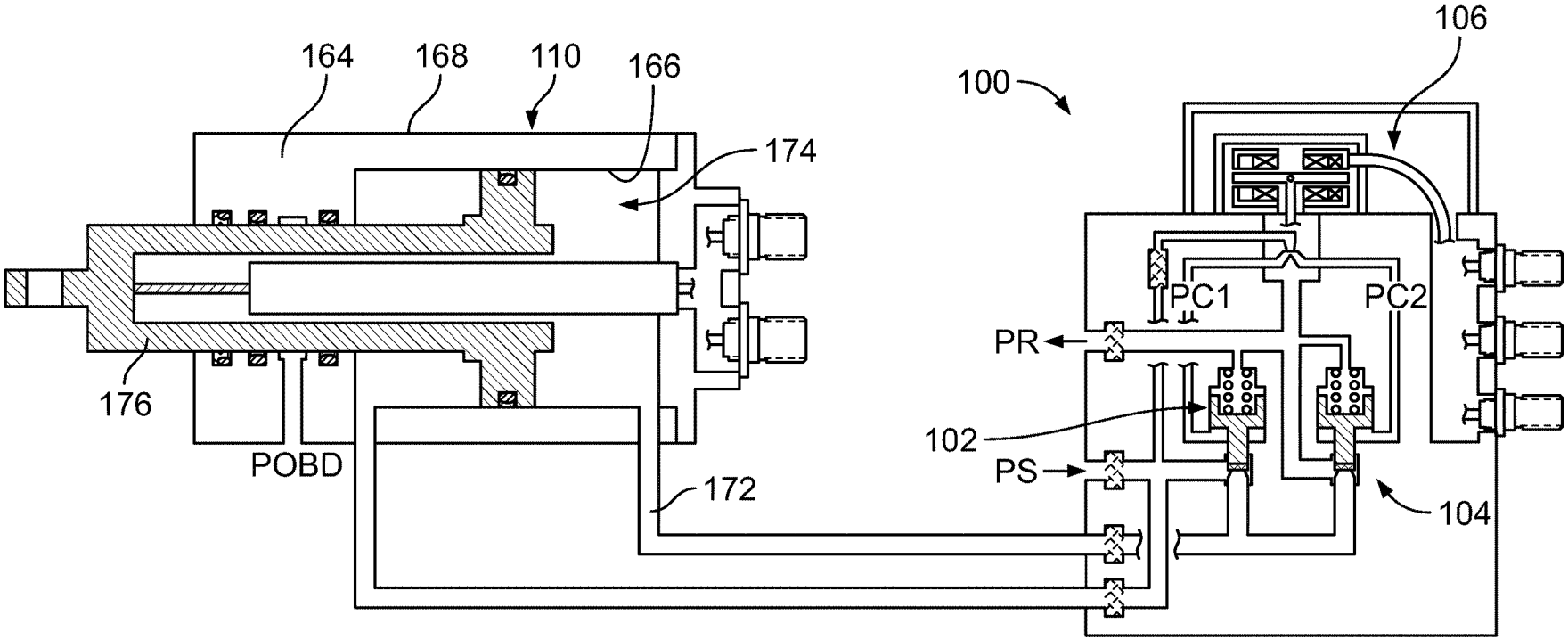
FIG. 1 depicts a schematic representation of one embodiment of an electrohydraulic poppet valve (EHPV) device control system that is coupled to an actuator, requires one control pressure, maintains the last commanded position of the actuator, and provides back-up position control of the actuator.

Referring now to FIG. 1, a system 100, and more specifically an electrohydraulic poppet valve (EHPV) device control system 100 that controls the position of a device 110, and that maintains the last commanded position of the device 110 upon power interruption to the (EHPV) device control system 100, is depicted. The system 100 includes a main body 101, an extend valve 102, a retract valve 104, and an actuator 106, and is in fluid communication with the device 110 whose position it is controlling.

Figure 2:
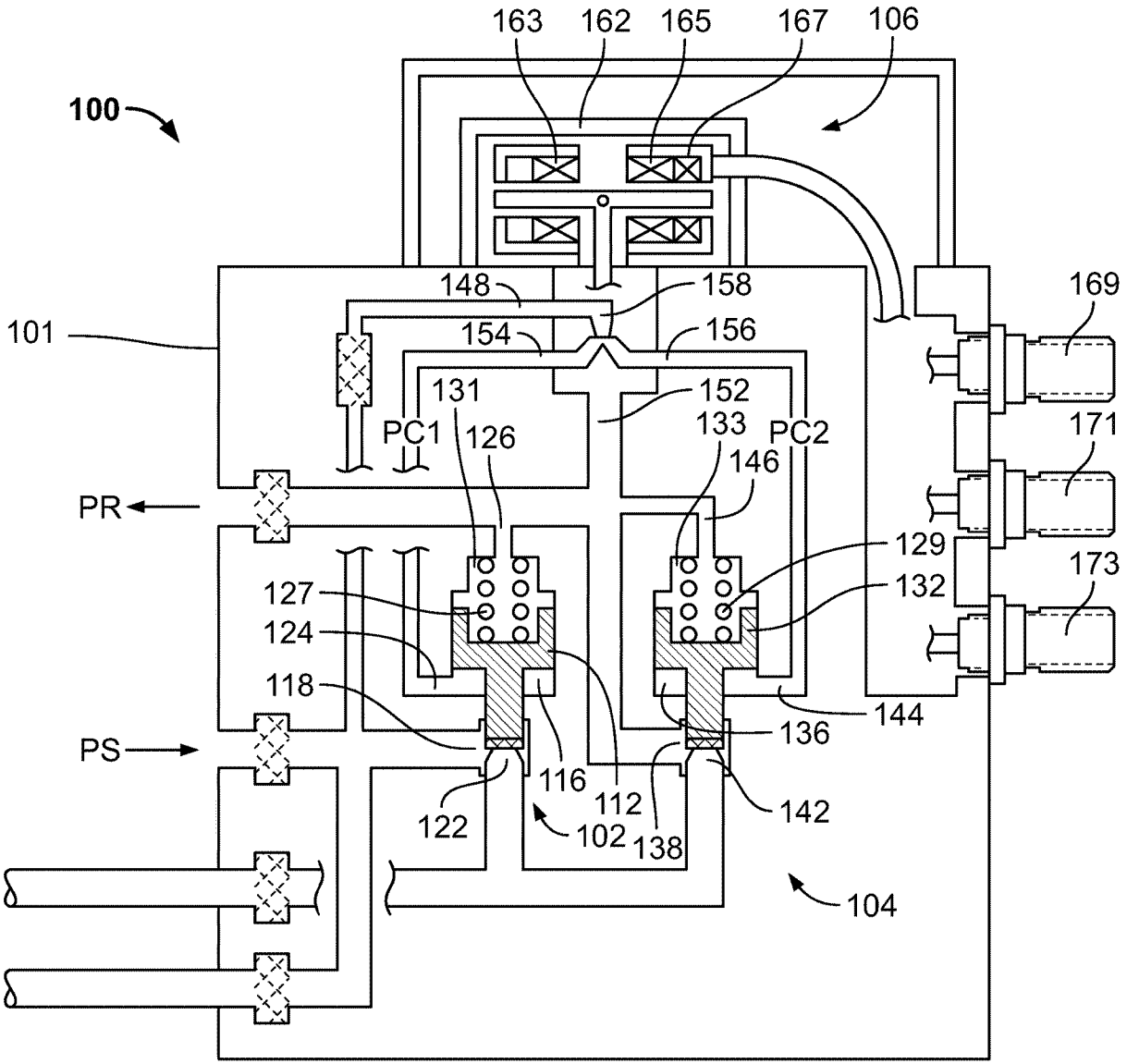
FIGS. 2-4 depict the EHPV device control system of FIG. 1 in fixed, extend, and retract functional modes, respectively.
Figure 3:
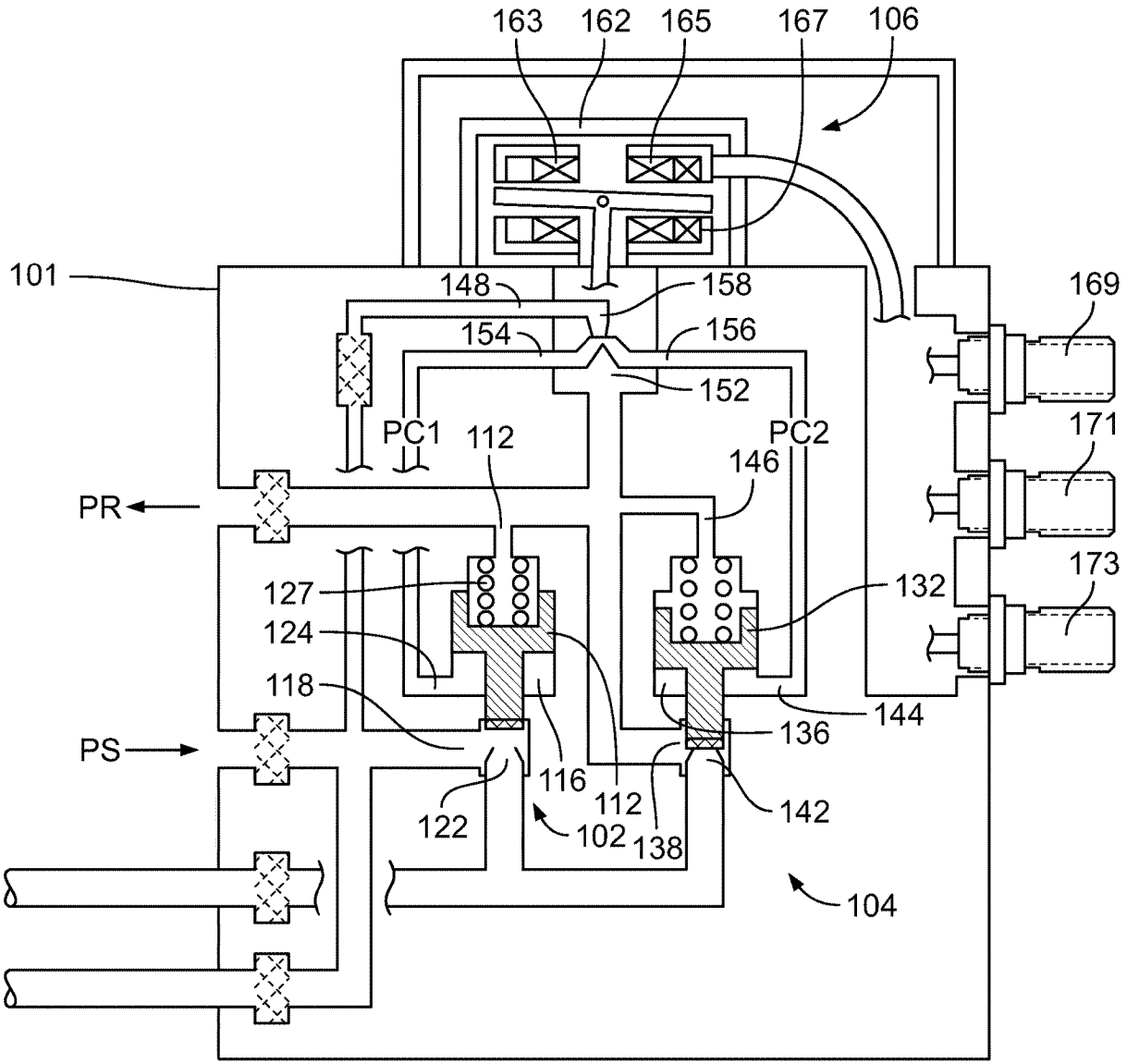
Figure 4:
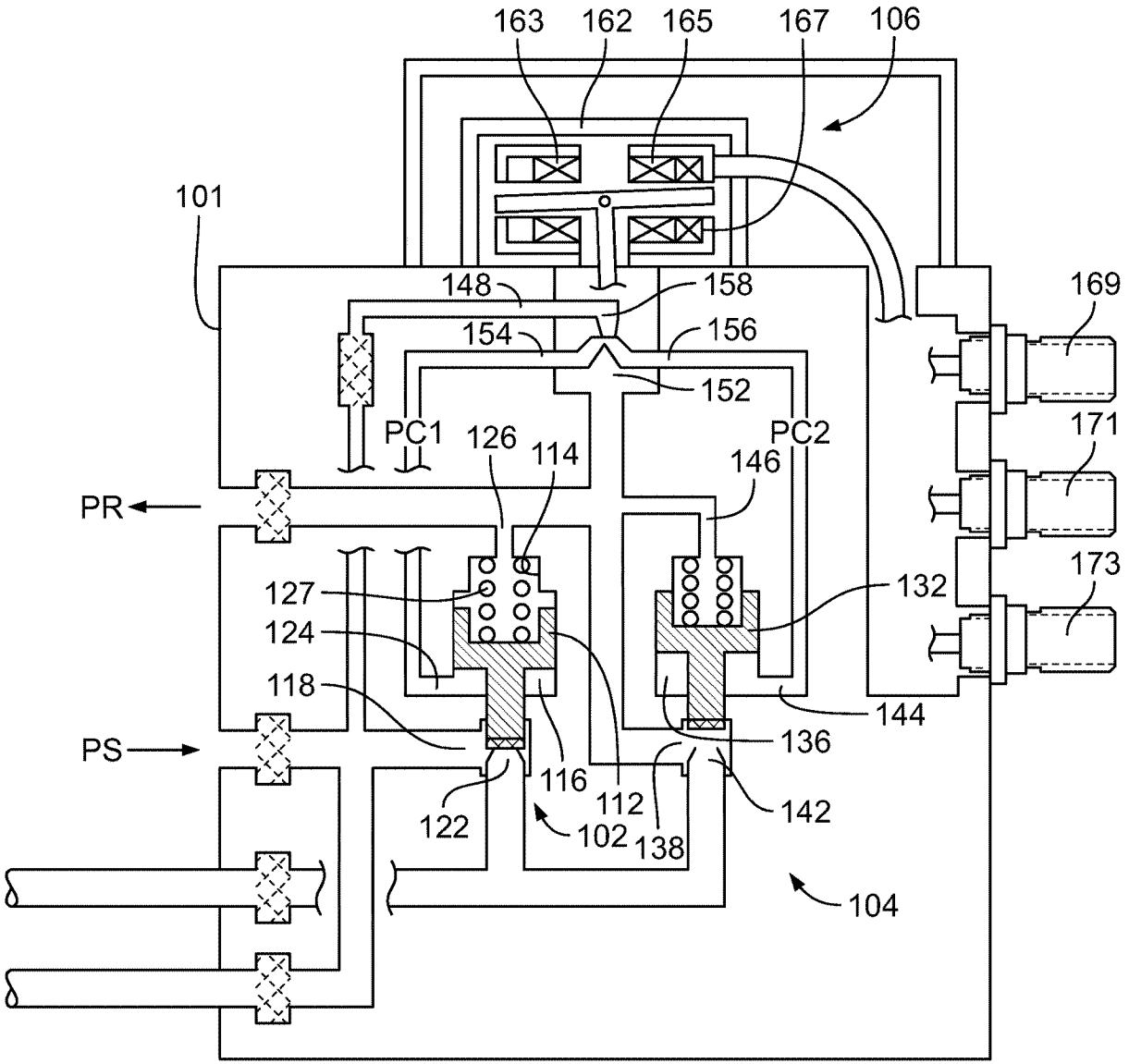

Referring now to FIGS. 2-4, it may be seen that the main body 101 has an extend valve bore 116 and a retract valve bore 136 defined therein. The extend valve bore 116 includes an extend valve inlet port 118, an extend valve outlet port 122, an extend valve control pressure port 124, and an extend valve return pressure port 126.

An extend poppet valve 112 is disposed within the extend valve bore 116 and is movable therein between an open position and a closed position. In the closed position, which is the position depicted in FIGS. 1, 2, and 4, the extend valve inlet port 118 is fluidly isolated from the extend valve outlet port 122. In the open position, which is the position depicted in FIG. 3, the extend valve inlet port 118 is in fluid communication with the extend valve outlet port 122.

The depicted extend valve 102 also includes an extend valve spring 127. The extend valve spring 127 is disposed within the extend valve bore 116 and engages the main body 101 and the extend poppet valve 112. More specifically, the extend valve spring 127 is disposed within an extend valve spring chamber 131 that is defined between the main body and the extend poppet valve 112. The extend valve spring 127 supplies a spring force to the extend poppet valve 112 that urges the extend poppet valve 112 toward its closed position.

The retract valve bore 136 includes a retract valve inlet port 138, a retract valve outlet port 142, a retract valve control pressure port 144, and a retract valve return pressure port 146.

A retract poppet valve 132 is disposed within the retract valve bore 136 and is movable therein between a closed position and an open position. In the closed position, which is depicted in FIGS. 1-3, the retract valve inlet port 138 is fluidly isolated from the retract valve outlet port 142. In the open position, which is the position depicted in FIG. 4, the retract valve inlet port 138 is in fluid communication with the retract valve outlet port 142.

The depicted retract valve 104 also includes a retract valve spring 129. The retract valve spring 129 is disposed within the retract valve bore 136 and engages the main body 101 and the retract poppet valve 132. More specifically, the retract valve spring 129 is disposed within a retract valve spring chamber 133 that is defined between the main body 101 and the retract poppet valve 132. The retract valve spring 129 supplies a spring force to the retract poppet valve 132 that urges the retract poppet valve 132 toward its closed position.

The actuator 106 includes an actuator supply pressure port 148, an actuator return pressure port 152, an extend control pressure port 154, and a retract control pressure port 156. The actuator return pressure port 152 is in fluid communication with the extend valve return pressure port 126 and the retract valve return pressure port 146, the extend control pressure port 154 is in fluid communication with extend valve control pressure port 124, and the retract control pressure port 156 is in fluid communication with retract valve control pressure port 144. As FIGS. 1-4 also show, the actuator supply pressure port 148 is adapted to receive a flow of pressurized fluid, at a supply pressure (PS), from a non-illustrated fluid source, and the actuator return pressure port 152, and thus the extend valve return pressure port 126 and the retract valve return pressure port 146, is in fluid communication with the non-illustrated fluid source at a return pressure (PR).

The actuator 106 is movable to an extend position, a retract position, and a null position. In the extend position, which is the position depicted in FIG. 3, the actuator supply pressure port 148 is in fluid communication with the extend valve control pressure port 124, and the actuator return pressure port 152 is in fluid communication with the retract valve control pressure port 144. As a result, fluid pressure at the extend valve control pressure port 124 (PC1) is at supply pressure (PS) and fluid pressure at the retract valve control pressure port 144 (PC2) is at return pressure (PR). The fluid pressure at the extend valve control pressure port 124 (PC1) overcomes the spring force of the extend valve spring 127 and moves the extend poppet valve 112 to its open position. However, the fluid pressure at the retract valve control pressure port 144 (PC2) is insufficient to overcome the spring force of the retract valve spring 129 and thus the retract poppet valve 132 remains in its closed position.

In the retract position, which is the position depicted in FIG. 4, the actuator supply pressure port 148 is in fluid communication with the retract valve control pressure port 144, and the actuator return pressure port 152 is in fluid communication with the extend valve control pressure port 124. As a result, fluid pressure at the retract valve control pressure port 144 (PC2) is at supply pressure (PS) and fluid pressure at the extend valve control pressure port 124 (PC1) is at return pressure (PR). The fluid pressure at the retract valve control pressure port 144 (PC2) overcomes the spring force of the retract valve spring 129 and moves the retract poppet valve 132 to its open position. However, the fluid pressure at the extend valve control pressure port 124 (PC1) is insufficient to overcome the spring force of the extend valve spring 127 and thus the extend poppet valve 112 remains in its closed position.

In the null position, which is the position depicted in FIGS. 1 and 2, the actuator supply pressure port 148 and the actuator return pressure port 152 are fluidly coupled to both of the extend valve control pressure port 124 and the retract valve control pressure port 144. As a result, the fluid pressures at the extend valve control pressure port 124 (PC1) and at the retract valve control pressure port 144 (PC2) are both insufficient to overcome the spring force of the extend valve spring 127 and the retract valve spring 129, respectively. Thus, the extend poppet valve 112 and the retract valve poppet 132 either move to or remain in the closed positions.

The actuator 106 is configured to move to, or remain in, the null position when it is not receiving electrical power. Thus, when electrical power is not supplied to the actuator 106 for any reason, be it removal of a command that causes the actuator 106 to move to its extend or retract position, or in the unlikely event of a loss of electrical power to the actuator 106, it will move to, or remain in, the null position.

Although the actuator 106 may be variously implemented to carry out its functionality, in the depicted embodiment it is implemented as a torque motor jet tube actuator. The depicted actuator 106 thus includes a jet tube 158 and a torque motor 162. The jet tube 158 is in fluid communication with the actuator supply pressure port 148 and is movable to the extend position, the retract position, and the null position. The torque motor 162 is coupled to the jet tube 158 and is responsive to commands received from a non-illustrated control source to control the position of the jet tube 158.

In a particular preferred embodiment, the torque motor 162, when included, is implemented using a three-channel torque motor having a first coil 163 (e.g., a FADEC controlled channel A coil) coupled to a first electrical connector 169, a second coil 165 (e.g., a FADEC controlled channel B coil) coupled to a second electrical connector 171, and a third coil 167 (e.g., a back-up airframe commanded coil) coupled to a third electrical connector 173. A distinct advantage to this type of torque motor 162 is that it can continue to function in the unlikely event that one of the first or second coils 163, 165 were to become inoperable. It has the further advantage that in the unlikely event both of the first and second coils 163, 165 were to become inoperable, the third coil 167 can be intermittently energized by, for example, an aircraft pilot to achieve manual back-up position control of the device 110.

It will be appreciated that in other embodiments, various other types valve actuators or torque motors could be used. No matter the type of valve actuator, however, in the unlikely event that power is interrupted to the system 100 (e.g., the torque motor 162 or other valve actuator), the torque motor 162 (or other valve actuator) is configured to move the jet tube 158 to, or cause it to remain in, the null position, or to intermittently move when back-up control is being used.

In another embodiment, which is depicted in FIGS. 5-8, the (EHPV) device control system 500 includes the same elements as the system 100 depicted in FIG. 1, and additionally includes a second extend valve 502 and a second retract valve 504. In this additional embodiment, those elements common to the system depicted in FIGS. 1-4 (though oriented slightly different), and that were described above, are depicted in FIGS. 5-8 with the same reference numerals, and detailed descriptions thereof will not be repeated.

Figure 6:
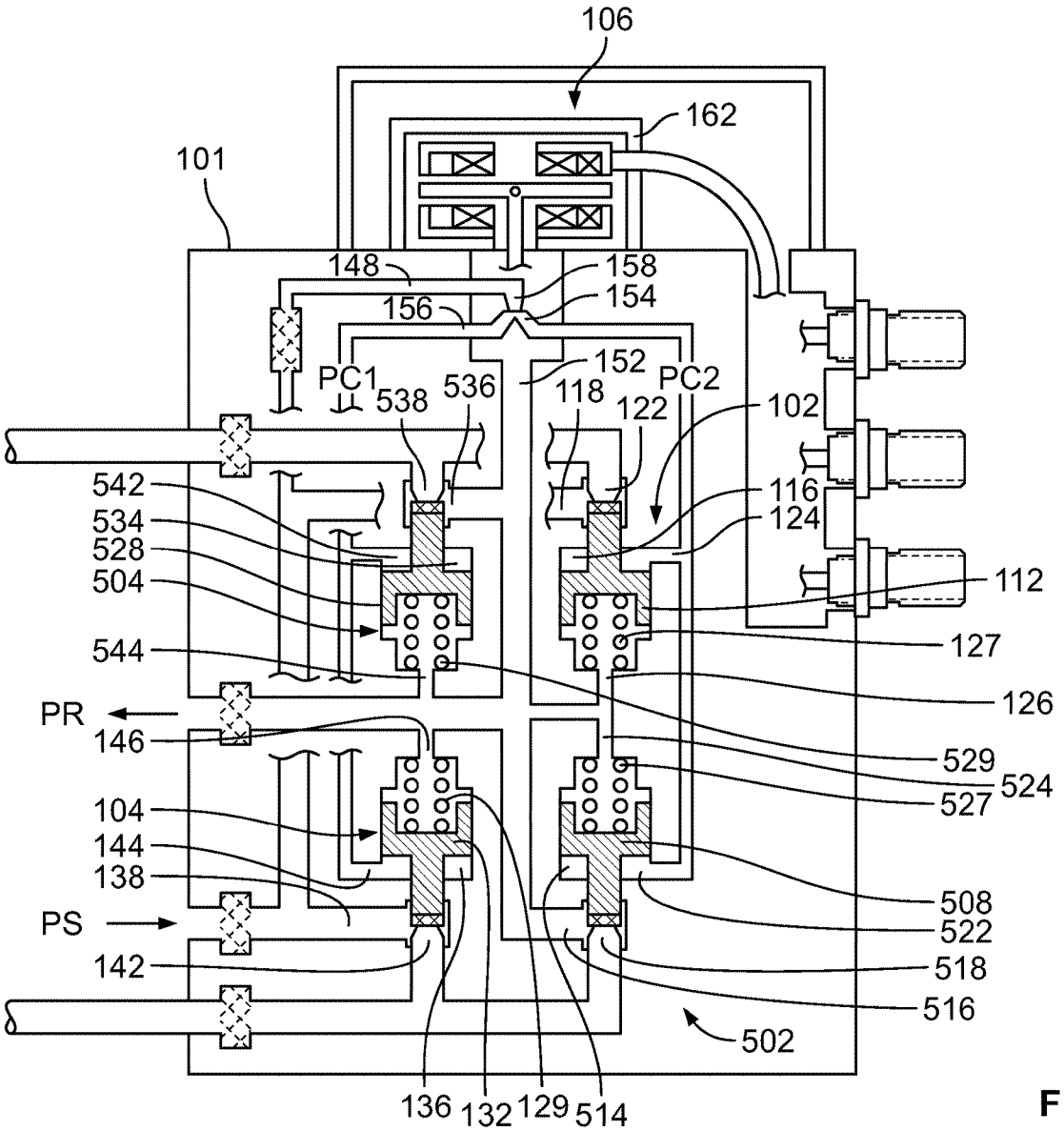
FIGS. 6-8 depict the EHPV device control system of FIG. 5 in fixed, extend, and retract functional modes, respectively.

Referring now to FIG. 6, it is seen that a second extend valve bore 514 and a second retract valve bore 534 are defined in the main body 101. The second extend valve bore 514 includes a second extend valve inlet port 516, a second extend valve outlet port 518, a second extend valve control pressure port 522, and a second extend valve return pressure port 524.

A second extend poppet valve 508 is disposed within the second extend valve bore 514 and is movable therein between an open position and a closed position. In the closed position, which is the position depicted in FIGS. 5, 6, and 8, the second extend valve inlet port 516 is fluidly isolated from the second extend valve outlet port 518. In the open position, which is the position depicted in FIGS. 5 and 7, the second extend valve inlet port 516 is in fluid communication with the second extend valve outlet port 518.

The depicted second extend valve 502 also includes a second extend valve spring 527. The second extend valve spring 527 is disposed within the second extend valve bore 514 and engages the main body 101 and the second extend poppet valve 508. The second extend valve spring 527 supplies a spring force to the second extend poppet valve 508 that urges the second extend poppet valve 508 toward its closed position.

The second retract valve bore 534 includes a second retract valve inlet port 536, a second retract valve outlet port 538, a second retract valve control pressure port 542, and a second retract valve return pressure port 544.

Figure 5:
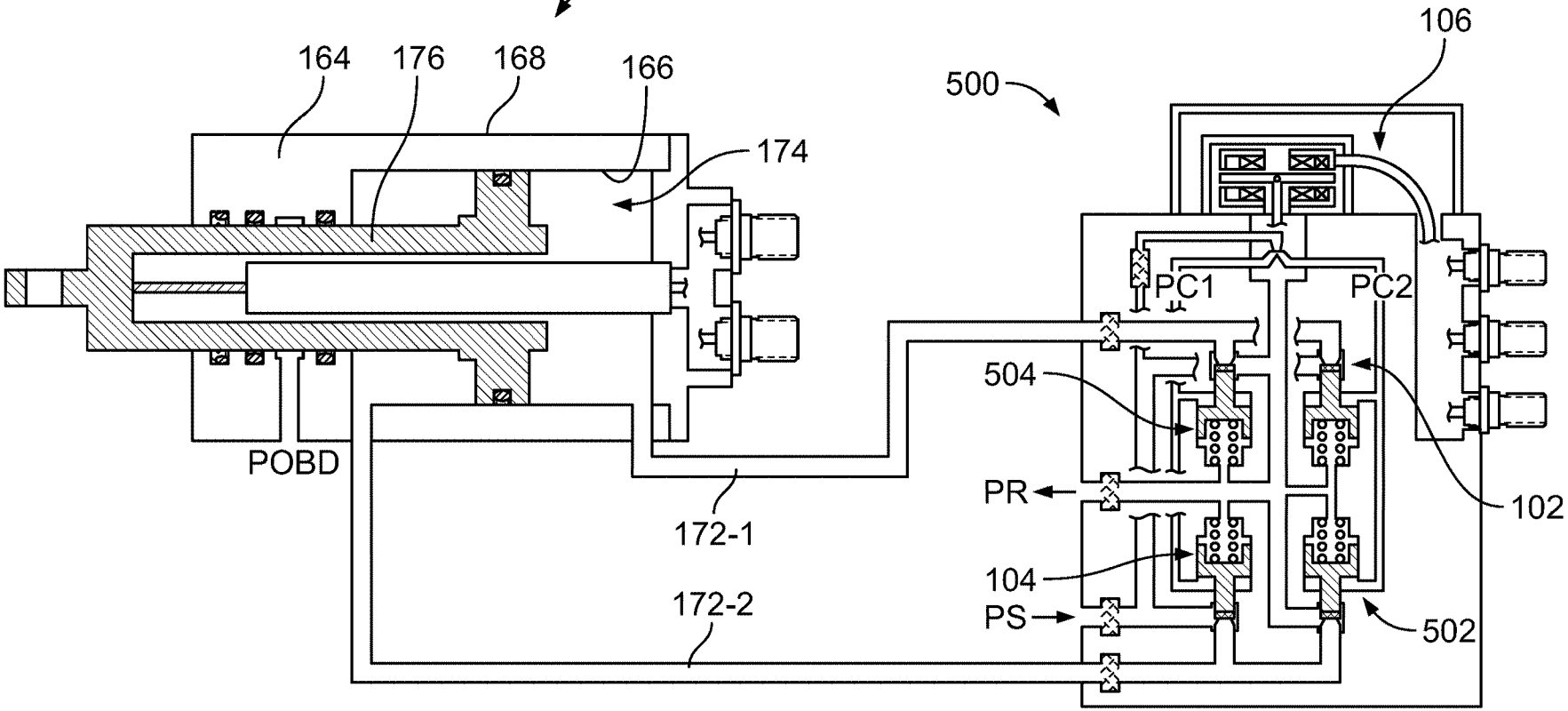
FIG. 5 depicts a schematic representation of another embodiment of an EHPV device control system that is coupled to an actuator, requires two control pressures, maintains the last commanded position of the actuator, and provides back-up position control of the actuator.
Figure 7:
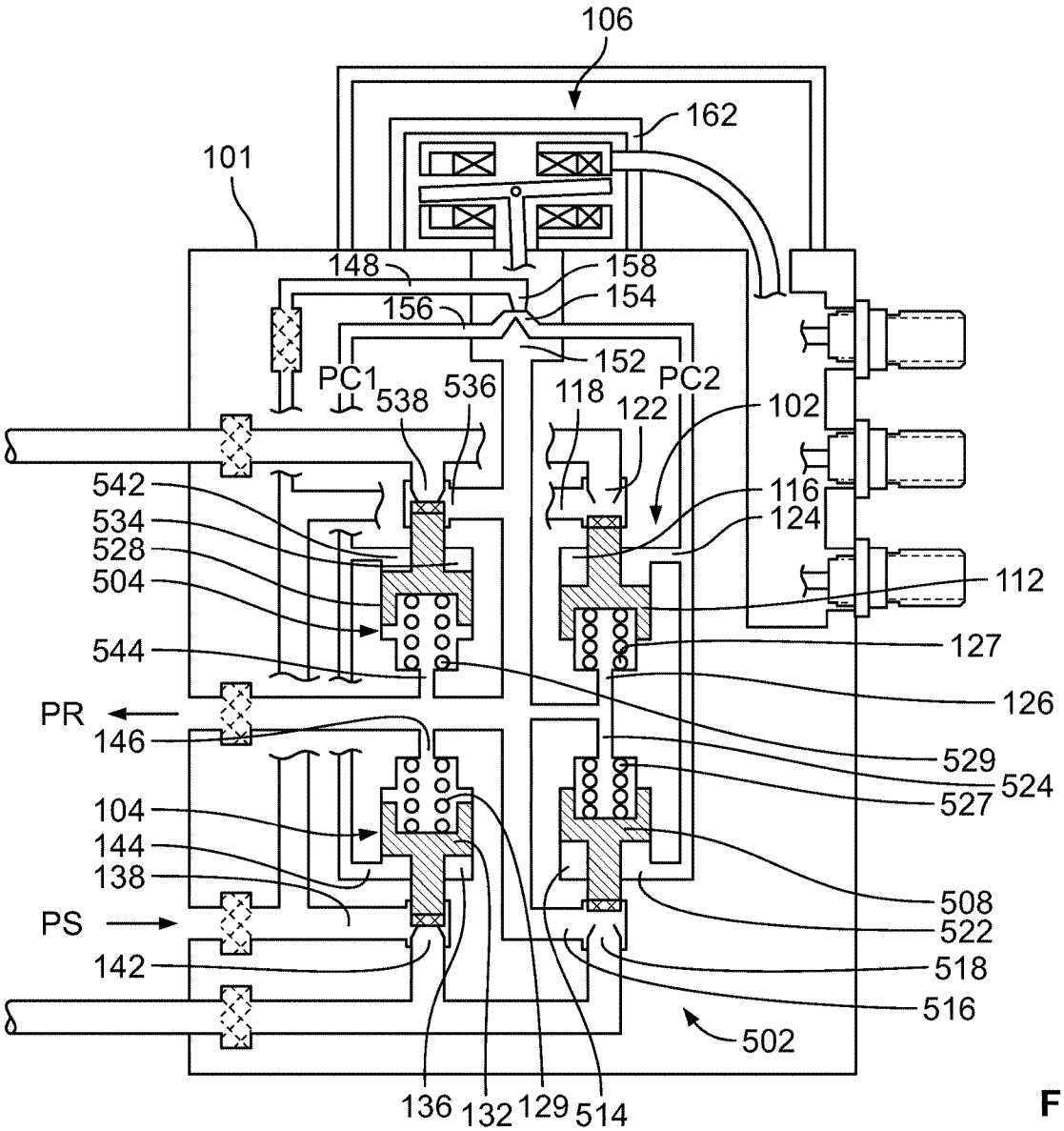

A second retract poppet valve 528 is disposed within the second retract valve bore 534 and is movable therein between a closed position and an open position. In the closed position, which is depicted in FIGS. 5-7, the second retract valve inlet port 536 is fluidly isolated from the second retract valve outlet port 538. In the open position, which is the position depicted in FIG. 8, the second retract valve inlet port 536 is in fluid communication with the second retract valve outlet port 538.

The depicted second retract valve 504 also includes a second retract valve spring 529. The second retract valve spring 529 is disposed within the second retract valve bore 534 and engages the main body 101 and the second retract poppet valve 528. The second retract valve spring 529 supplies a spring force to the second retract poppet valve 528 that urges the second retract poppet valve 528 toward its closed position.

As FIGS. 5-8 further depict, the extend valve control pressure port 124 is in fluid communication with second extend valve control pressure port 522, and the retract valve control pressure port 144 in is fluid communication with second retract valve control pressure port 542. Moreover, the actuator return pressure port 152, in addition to being in fluid communication with the extend valve return pressure port 126 and the retract valve return pressure port 146, is in fluid communication with the second extend valve return pressure port 524 and the second retract valve return pressure port 544. The extend control pressure port 154, in addition to being in fluid communication with the extend valve control pressure port 124, is in fluid communication with the second extend valve control pressure port 522, and the retract control pressure port 156, in addition to being in fluid communication with retract valve control pressure port 144, is in fluid communication with second retract valve control pressure port 542.

With this embodiment, when the actuator 106 is in the extend position, which is the position depicted in FIG. 7, the actuator supply pressure port 148 is in fluid communication with the extend valve control pressure port 124 and the second extend valve control pressure port 522, and the actuator return pressure port 152 is in fluid communication with the retract valve control pressure port 144 the second retract valve control pressure port 542. As a result, fluid pressure (PC2) at the extend valve control pressure port 124 and the second extend valve control pressure port 522 is at supply pressure (PS), and fluid pressure (PC1) at the retract valve control pressure port 144 and the second retract valve control pressure port 542 is at return pressure (PR). The fluid pressure (PC2) at the extend valve control pressure port 124 and the second extend valve control pressure port 522 overcomes the spring forces of the extend valve spring 127 and the second extend valve spring 527 and moves the extend poppet valve 112 and the second extend poppet valve 508 to their open positions. However, the fluid pressure (PC1) at the retract valve control pressure port 144 and the second retract valve control pressure port 542 is insufficient to overcome the spring force of the retract valve spring 129 and the second retract valve spring 529. Thus, the retract poppet valve 132 and the second retract poppet valve 528 remain in their closed positions.

Figure 8:
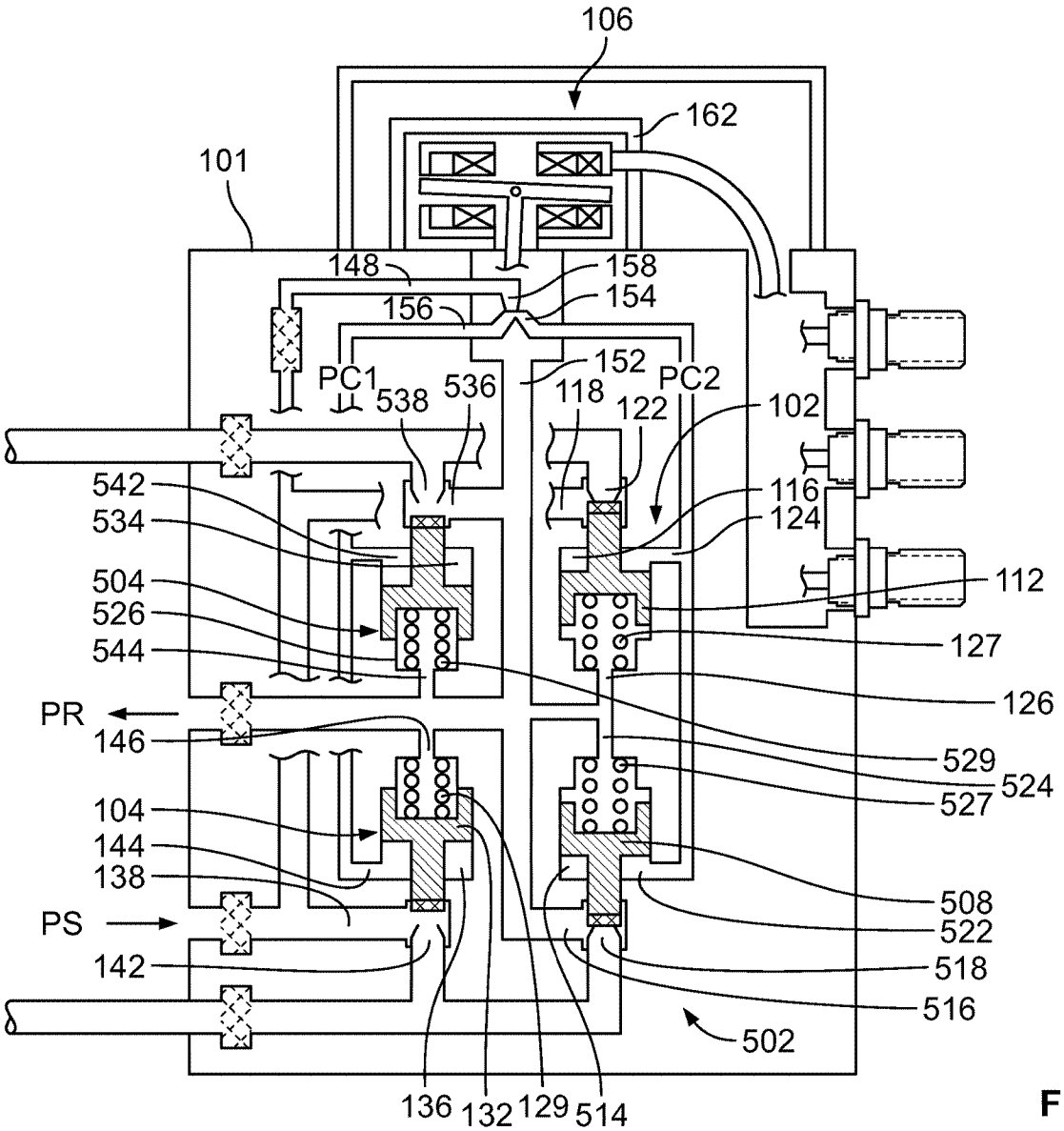

When the actuator 106 is in the retract position, which is the position depicted in FIG. 8, the actuator supply pressure port 148 is in fluid communication with the retract valve control pressure port 144 and the second retract valve control pressure port 542, and the actuator return pressure port 152 is in fluid communication with the extend valve control pressure port 124 the second extend valve control pressure port 522. As a result, fluid pressure (PC1) at the retract valve control pressure port 144 and the second retract valve control pressure port 542 is at supply pressure (PS), and fluid pressure (PC2) at the extend valve control pressure port 124 and the second extend valve control pressure port 522 is at return pressure (PR). The fluid pressure (PC1) at the retract valve control pressure port 144 and the second retract valve control pressure port 542 overcomes the spring forces of the retract valve spring 129 and the second retract valve spring 529 and moves the retract poppet valve 132 and the second retract poppet valve 528 to their open positions. However, the fluid pressure (PC2) at the extend valve control pressure port 124 and the second extend valve control pressure port 522 is insufficient to overcome the spring forces of the extend valve spring 127 and the second extend valve spring 527. Thus, the extend poppet valve 112 and the second extend poppet valve 508 remain in their closed positions.

When the actuator 106 is in the null position, which is the position depicted in FIGS. 5 and 6, the actuator supply pressure port 148 and the actuator return pressure port 152 are fluidly coupled to all of the extend valve control pressure port 124, the second extend valve control pressure port 522, the retract valve control pressure port 144, and the second retract valve control pressure port 542. As a result, the fluid pressure (PC2) at the extend valve control pressure port 124 the second extend valve control pressure port 522, and the fluid pressure (PC1) at the retract valve control pressure port 144 and the second retract valve control pressure port 542 are insufficient to overcome the spring forces of the springs 127, 527 and 129, 529, respectively. Thus, the extend poppet valve 112, the second extend poppet valve 508, the retract valve poppet 132, and the second retract poppet valve 528 either move to or remain in the closed positions.

Figure 9:
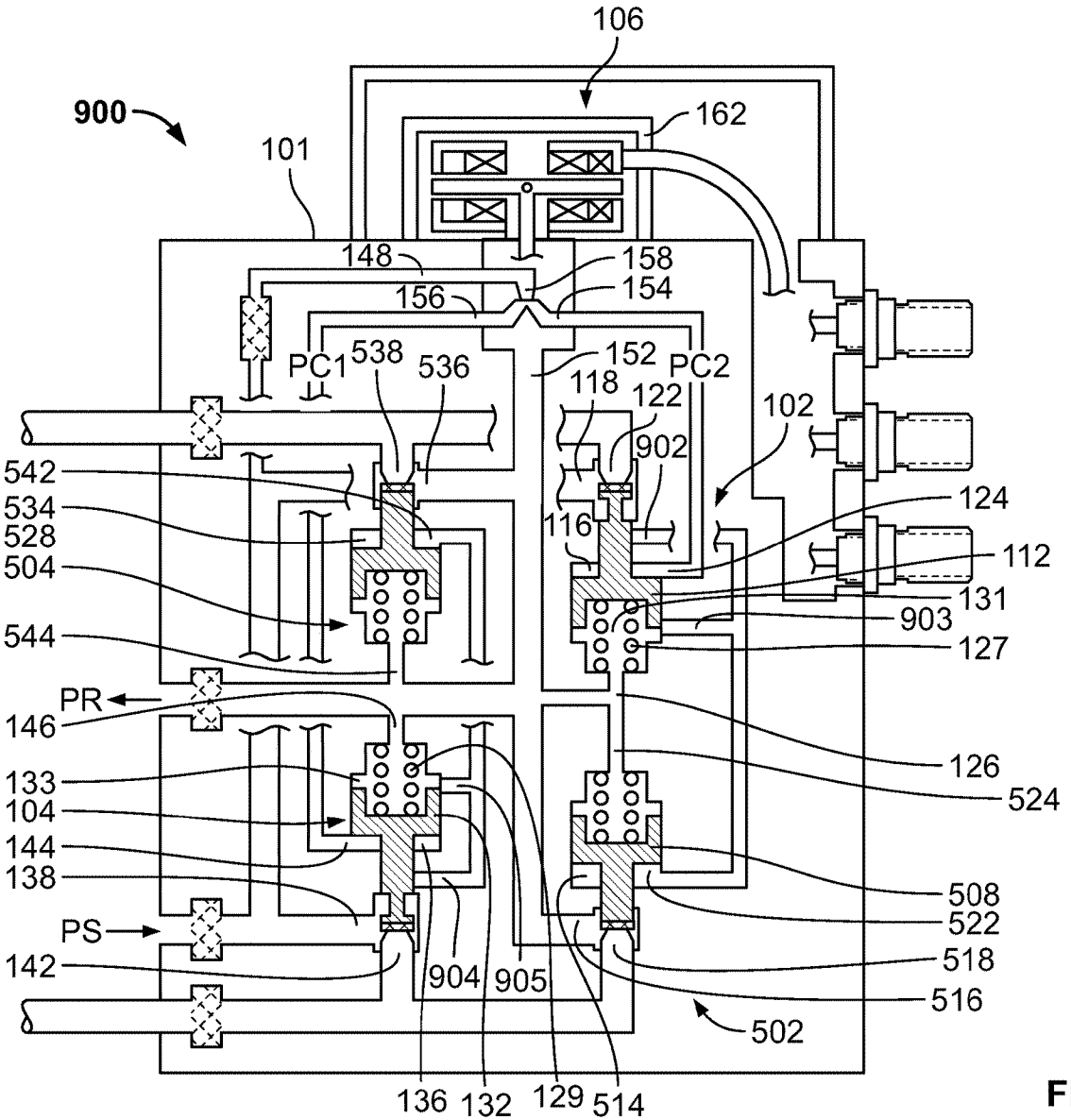
FIGS. 9-11 depict another embodiment of an EHPV device control system that requires two control pressures, in fixed, extend, and retract functional modes, respectively.
Figure 10:
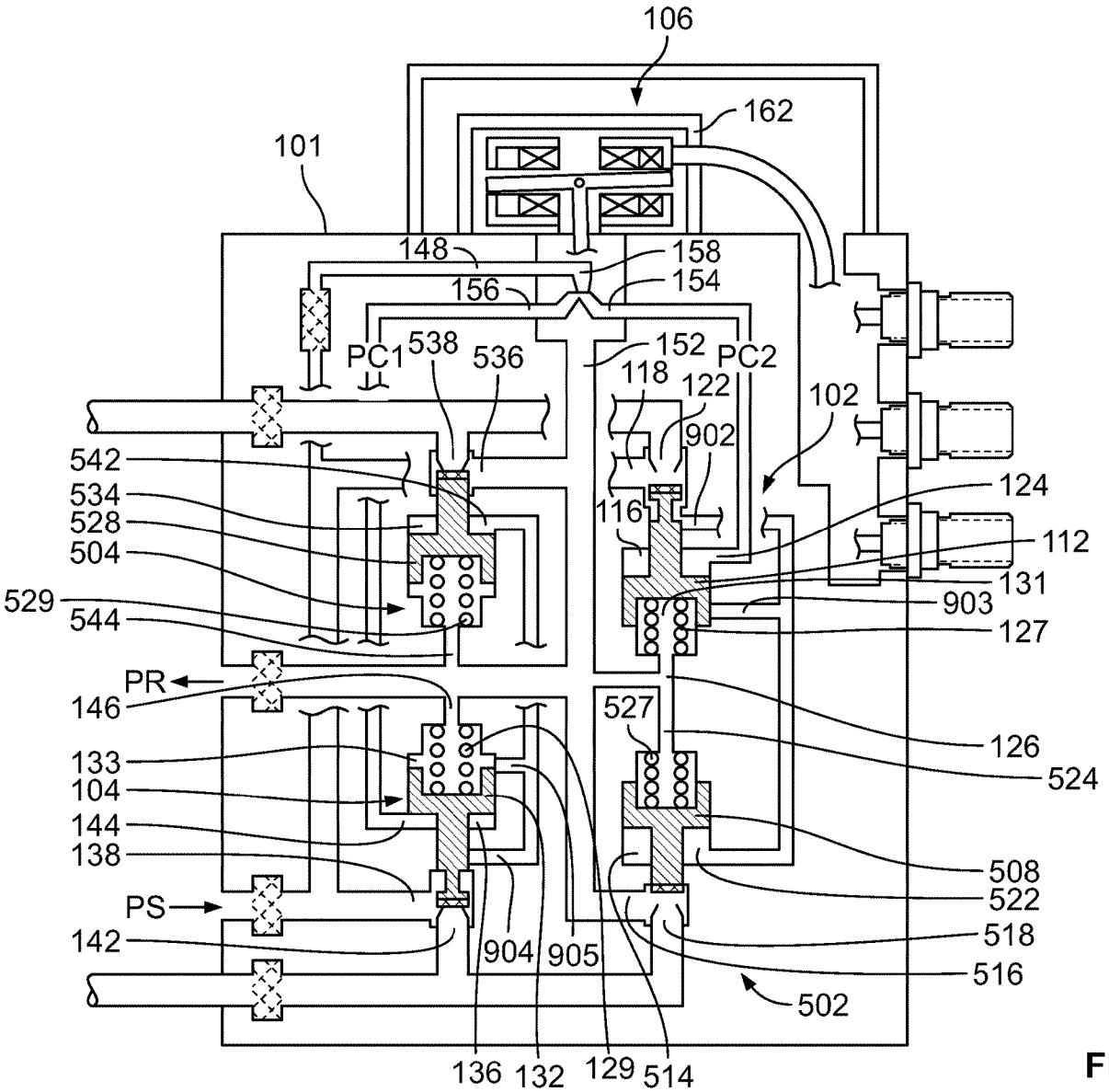
Figure 11:
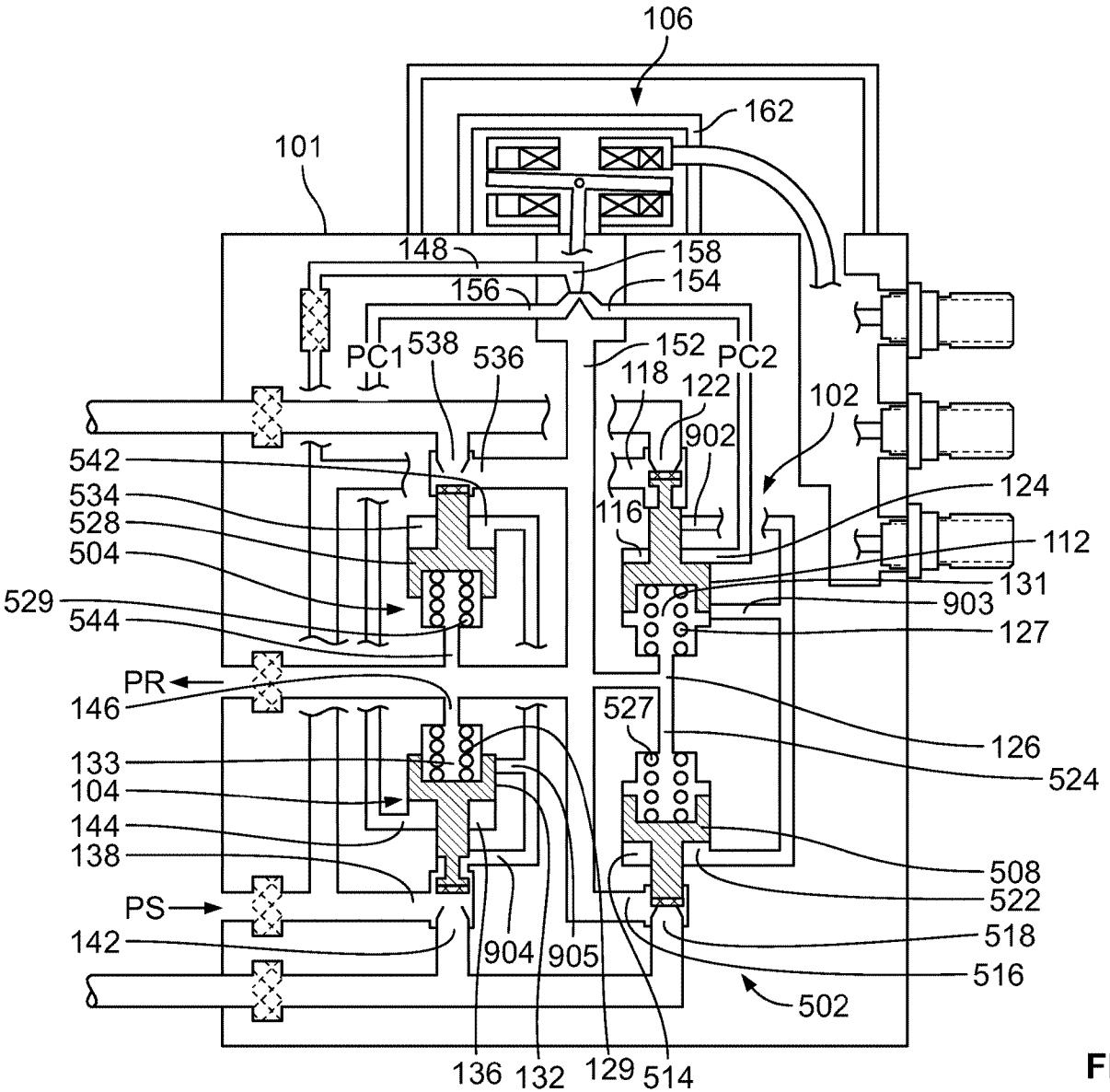

Turning now to FIGS. 9-11, yet another embodiment of the (EHPV) device control system 900 is depicted. This embodiment includes the same elements as the system 500 depicted in FIGS. 5-8 but, as will be described, includes additional ports. In this additional embodiment, those elements common to the system depicted in FIGS. 5-8, and that were described above, are depicted in FIGS. 9-11 with the same reference numerals, and detailed descriptions thereof will not be repeated.

In the embodiment depicted in FIGS. 9-11, the extend valve bore 116 further includes first and second auxiliary extend valve control pressure ports 902 and 903, and the retract valve bore 136 further includes first and second auxiliary retract valve control pressure ports 904 and 905. The addition of control pressure ports 902, 903,904 and 905 makes the extend and retract valves 102 and 104 operate as "master" extend and retract valves, respectively, which in turn control the position of "slave" extend and retract valves 502 and 504, respectively. The actuator 106 controls the position of master extend and retract valves 102 and 104.

As illustrated in FIGS. 9-11, the first and second auxiliary extend valve control pressure ports 902, 903 are both in continuous fluid communication with the second extend valve control pressure port 522, regardless of the position of the extend poppet valve 112. When the extend poppet valve 112 is in its closed position, as depicted in FIGS. 9 and 11, the first auxiliary extend valve control pressure port 902 is in fluid communication with the extend valve spring chamber 131, and the second auxiliary extend valve control pressure port 903 is in fluid communication with the extend valve return pressure port 126 and extend valve spring chamber 131. As illustrated in FIG. 10, when the extend poppet valve 112 is in its open position, the first and second auxiliary extend valve control pressure ports 902, 903 are in fluid communication with the extend valve inlet and outlet ports 118, 122, and are fluidly isolated from the extend valve spring chamber 131.

As FIGS. 9-11 also depict, the first and second auxiliary retract valve control pressure ports 904, 905 are both in continuous fluid communication with the second retract valve control pressure port 542, regardless of the position of the retract poppet valve 132. When the retract poppet valve 132 is in its closed position, as depicted in FIGS. 9 and 10, the first auxiliary retract valve control pressure port 904 is in fluid communication with the retract valve spring chamber 133, and the second auxiliary retract valve control pressure port 905 is in fluid communication with the retract valve return pressure port 146 and the retract valve spring chamber 133. As illustrated in FIG. 11, when the retract poppet valve 112 is in its open position, the first and second auxiliary retract valve control pressure ports 904, 905 are in fluid communication with the retract valve inlet and outlet ports 138, 142, and are fluidly isolated from the retract valve spring chamber 133.

The system 900 depicted in FIGS. 9-11 operates substantially identical to the system 500 depicted in FIGS. 5-8, thus a detailed description thereof will not be provided. It is noted, however, that the configurations of the first and second auxiliary extend valve control pressure ports 902, 903, and the first and second auxiliary retract valve control pressure ports 904, 905 limits control pressure flow (PC1, PC2) to just one of the poppets when the actuator 106 is commanded to the extend position or the retract position. More specifically, in the extend position, control pressure flow (PC2) is limited to the master extend valve 102, and in the retract position, control pressure flow (PC1) is limited to the master retract valve 104. This has the advantage of limiting the amount of control pressure flow (PC1, PC2) required to actuate the poppet valves 112, 132, which minimizes quiescent servo flow usage. It also allows the use of larger poppet valves that would require higher control pressure flow (PC1, PC2). It is further seen that the extend valve poppet 112 and the retract valve poppet 132 are contoured, near their respective seating surfaces, to allow this control pressure flow when the poppet valves 112, 132 are moved between the open and closed positions.

Each of the (EHPV) device control systems 100, 500, 900 is in fluid communication with, and is used to control the position of, a device 110. The device 110 being controlled may vary. For example, in the embodiments depicted in FIGS. 1-11, the device 110 is a hydraulically controlled actuator. In other embodiments, however, the device 110 may be, for example, a hydraulically controlled valve, such as a metering valve.

Figure 12:
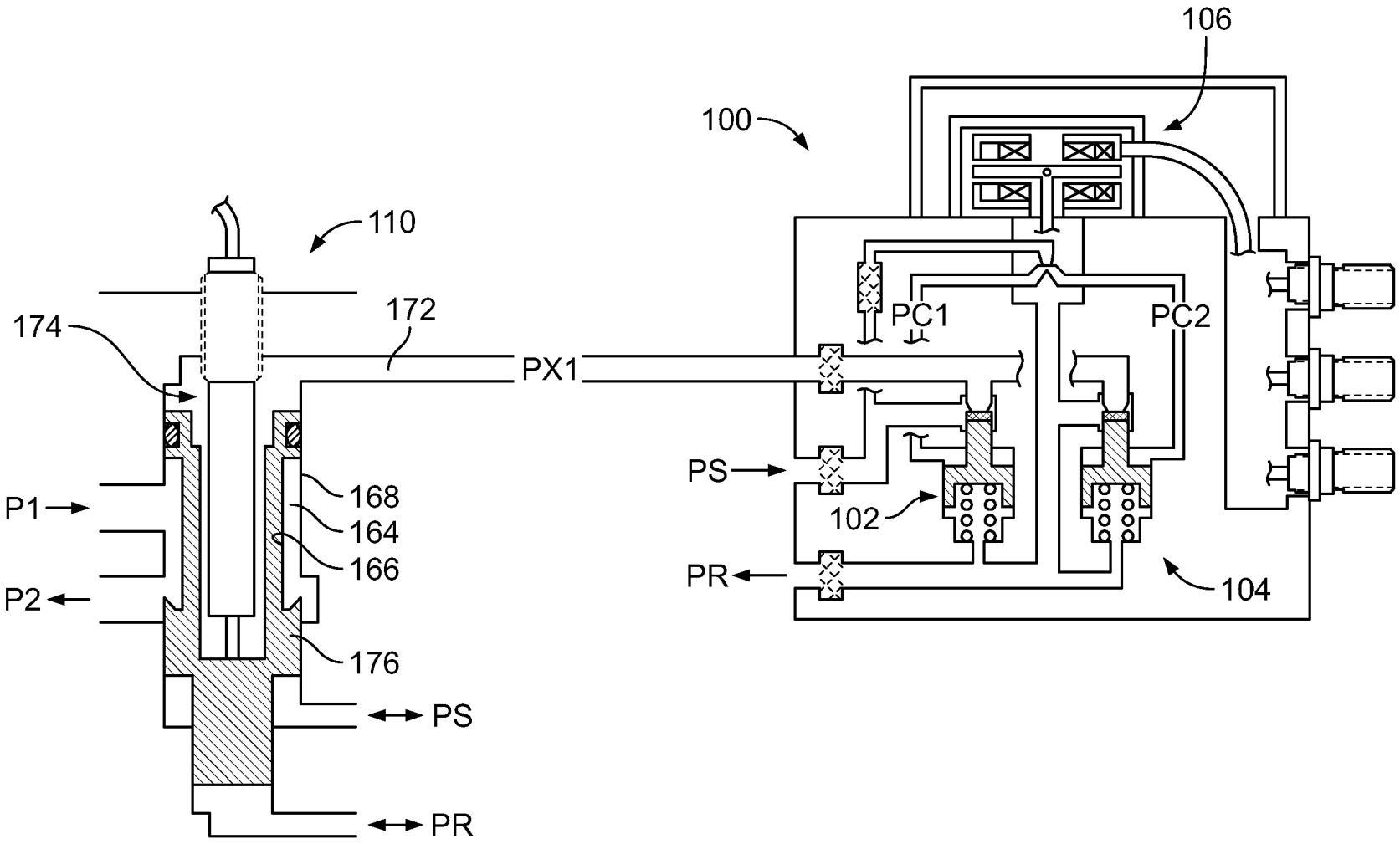
FIG. 12 depicts the EHPV device control system of FIG. 1 coupled to a metering valve and that requires one control pressure.
Figure 13:
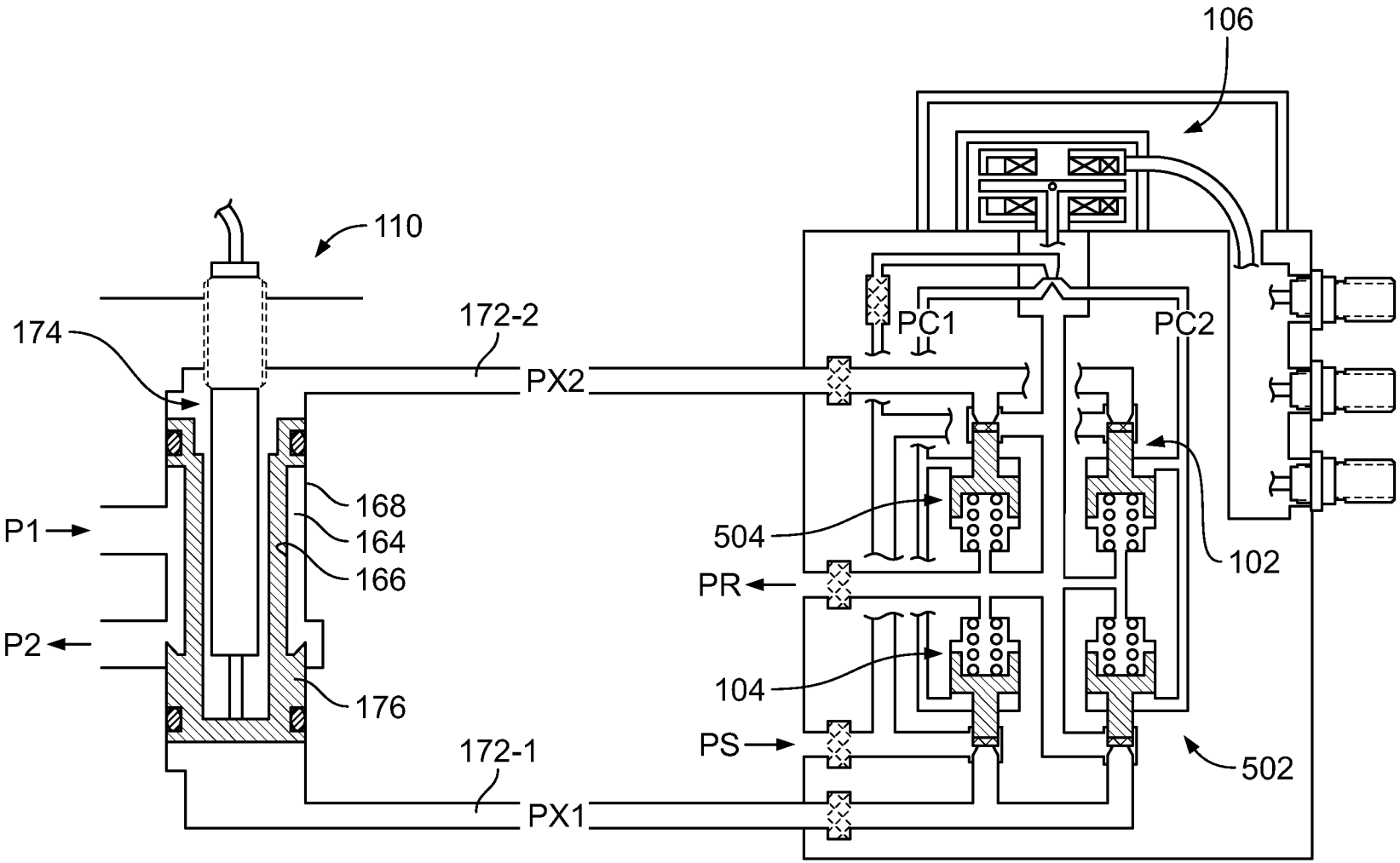
FIG. 13 depicts the EHPV device control system of FIG. 5 coupled to a metering valve and that requires two control pressures.

Regardless of the specific device 110, it includes at least a device housing 164 that has an inner surface 166, an outer surface 168, and at least one actuation control pressure port 172. With some embodiments, such as the ones depicted in FIGS. 5 and 13 the device housing 164 includes two actuation control pressure ports 172 (172-1, 172-2), whereas in the embodiments depicted in FIGS. 1 and 12, the device housing 164 includes only one actuation control pressure port 172.

Regardless of the number of actuation control pressure ports 172, the inner surface 166 of the device housing 164 defines a device cavity 174, within which a movable device 176 is at least partially disposed in and is movable within. The at least one actuation control pressure port 172 is in fluid communication with the extend valve outlet port 122 and the retract valve outlet port 142, and the movable device 176 is movable in response to at least fluid pressure in the at least one actuation control pressure port 172.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. An electrohydraulic poppet valve device control system, comprising:

a main body having an extend valve bore and a retract valve bore defined therein, the extend valve bore including an extend valve inlet port, an extend valve outlet port, an extend valve control pressure port, and an extend valve return pressure port, the retract valve bore including a retract valve inlet port, a retract valve outlet port, a retract valve control pressure port, and a retract valve return pressure port;

an extend poppet valve disposed within the extend valve bore and movable therein between a closed position, in which the extend valve inlet port is fluidly isolated from the extend valve outlet port, and an open position, in which the extend valve inlet port is in fluid communication with the extend valve outlet port;

a retract poppet valve disposed within the retract valve bore and movable therein between a closed position, in which the retract inlet port is fluidly isolated from the retract valve outlet port, and an open position, in which the retract inlet port is in fluid communication with the retract valve outlet port; and an actuator including an actuator supply pressure port, an actuator return pressure port, an extend control pressure port, and a retract control pressure port, the actuator return pressure port in fluid communication with the extend valve return pressure port and the retract valve return pressure port, the extend control pressure port in fluid communication with the extend valve control pressure port, the retract control pressure port in fluid communication with the retract valve control pressure port, the actuator movable to an extend position, a retract position, and a null position, wherein:

in the extend position, the actuator supply pressure port is in fluid communication with the extend valve control pressure port and the actuator return pressure port is in fluid communication with the retract valve control pressure port, thereby causing the extend poppet valve to be in its open position and the retract poppet valve to be in its closed position, in the retract position, the actuator supply pressure port is in fluid communication with the retract valve control pressure port and the actuator return pressure port is in fluid communication with the extend valve control pressure port, thereby causing the extend poppet valve to be in its closed position and the retract poppet valve to be in its open position, in the null position, the actuator supply pressure port and the actuator return pressure port are fluidly coupled to both of the extend valve control pressure port and the retract valve control pressure port, thereby causing the extend poppet valve to be in its closed position and the retract poppet valve to be in its closed position, and the actuator moves to, or remains in, the null position when electrical power is not supplied to the actuator, wherein the actuator comprises:

a jet tube in fluid communication with the actuator supply pressure port and movable to the extend position, the retract position, and the null position, and a three-channel torque motor coupled to the jet tube and responsive to commands to move the jet tube, the three-channel torque motor including a first coil, a second coil, and a third coil.

2. The system of claim 1, further comprising:

an extend valve spring disposed within the extend valve bore, the extend valve spring engaging the main body and the extend poppet valve and supplying a spring force to the extend poppet valve that urges the extend poppet valve toward its closed position; and a retract valve spring disposed within the retract valve bore, the retract valve spring engaging the main body and the retract poppet valve and supplying a spring force to the retract poppet valve that urges the retract poppet valve toward its closed position.

3. The system of claim 2, further comprising:

a second extend valve bore defined in the main body, the second extend valve bore including a second extend valve inlet port, a second extend valve outlet port, a second extend valve control pressure port, and a second extend valve return pressure port;

a second extend poppet valve disposed within the second extend valve bore and movable therein between a closed position, in which the second extend valve inlet port is fluidly isolated from the second extend valve outlet port, and an open position, in which the second extend valve inlet port is in fluid communication with the second extend valve outlet port;

a second retract valve bore defined in the main body, the second retract valve bore including a second retract valve inlet port, a second retract valve outlet port, a second retract valve control pressure port, and a second retract valve return pressure port; and a second retract poppet valve disposed within the second retract valve bore and movable therein between a closed position, in which the second retract inlet port is fluidly isolated from the second retract valve outlet port, and an open position, in which the second retract inlet port is in fluid communication with the second retract valve outlet port.

4. The system of claim 3, wherein:

in the extend position, the actuator supply pressure port is in fluid communication with the second extend valve control pressure port and the actuator return pressure port is in fluid communication with the second retract valve control pressure port, thereby causing the second extend poppet valve to be in its open position and the second retract poppet valve to be in its closed position, in the retract position, the actuator supply pressure port is in fluid communication with the second retract valve control pressure port and the actuator return pressure port is in fluid communication with the second extend valve control pressure port, thereby causing the second extend poppet valve to be in its closed position and the second retract poppet valve to be in its open position, and in the null position, the actuator supply pressure port and the actuator return pressure port are fluidly coupled to both of the second extend valve control pressure port and the second retract valve control pressure port, thereby causing the second extend poppet valve to be in its closed position and the second retract poppet valve to be in its closed position.

5. The system of claim 4, further comprising:

a second extend valve spring disposed within the second extend valve bore, the second extend valve spring engaging the main body and the second extend poppet valve and supplying a spring force to the second extend poppet valve that urges the second extend poppet valve toward its closed position; and a second retract valve spring disposed within the second retract valve bore, the second retract valve spring engaging the main body and the second retract poppet valve and supplying a spring force to the second retract poppet valve that urges the second retract poppet valve toward its closed position.

6. The system of claim 5, wherein:

the extend valve spring is disposed within an extend valve spring chamber that is defined between the main body and the extend poppet valve; and the retract valve spring is disposed within a retract valve spring chamber that is defined between the main body and the retract poppet valve.

7. The system of claim 6, wherein:

the extend valve bore further includes a first auxiliary extend valve control pressure port and a second auxiliary extend valve control pressure port;

the first auxiliary extend valve control pressure port is (i) in continuous fluid communication with the second extend valve control pressure port, (ii) in fluid communication with the extend valve spring chamber when the extend poppet valve is in its closed position, and (iii) in fluid communication with the extend valve inlet and outlet ports and fluidly isolated from the extend valve spring chamber when the extend poppet valve is in its open position;

the second auxiliary extend valve control pressure port is (i) in continuous fluid communication with the second extend valve control pressure port (ii) in fluid communication with extend valve return pressure port and the extend valve spring chamber when the extend poppet valve is in its closed position, and (iii) in fluid communication with the extend valve inlet and outlet ports and fluidly isolated from the extend valve spring chamber when the extend poppet valve is in its open position;

the retract valve bore further includes a first auxiliary retract valve control pressure port and a second auxiliary retract valve control pressure port;

the first auxiliary retract valve control pressure port is (i) in continuous fluid communication with the second retract valve control pressure port, (ii) in fluid communication with the retract valve spring chamber when the retract poppet valve is in its closed position, and (iii) in fluid communication with the retract valve inlet and outlet ports and fluidly isolated from the retract valve spring chamber when the retract poppet valve is in its open position; and the second auxiliary retract valve control pressure port is (i) in continuous fluid communication with the second retract valve control pressure port (ii) in fluid communication with retract valve return pressure port and the retract valve spring chamber when the retract poppet valve is in its closed position, and (iii) in fluid communication with the retract valve inlet and outlet ports and fluidly isolated from the retract valve spring chamber when the extend poppet valve is in its open position.

8. The system of claim 3, wherein the actuator return pressure port is in fluid communication with the second extend valve return pressure port and the second retract valve return pressure port, the extend control pressure port is in fluid communication with second extend valve control pressure port, and the retract control pressure port in is fluid communication with second retract valve control pressure port.

9. The system of claim 1, wherein:

the first coil is coupled to receive commands from a first channel of an engine control;

the second coil is coupled to receive commands from a second channel of the engine control; and the third coil is coupled to receive commands from a user interface.

10. The system of claim 1, further comprising:

a device housing having an inner surface, an outer surface, and at least one actuation control pressure port, the inner surface defining a device cavity, the at least one actuation control pressure port in fluid communication with the extend valve outlet port and the retract valve outlet port; and a device disposed at least partially in, and movable within, the device cavity, the device movable in response to at least fluid pressure in the at least one actuation control pressure port.

11. An electrohydraulic poppet valve device control system, comprising:

a main body having an extend valve bore and a retract valve bore defined therein, the extend valve bore including an extend valve inlet port, an extend valve outlet port, an extend valve control pressure port, and an extend valve return pressure port, the retract valve bore including a retract valve inlet port, a retract valve outlet port, a retract valve control pressure port, and a retract valve return pressure port;

an extend poppet valve disposed within the extend valve bore and movable therein between a closed position, in which the extend valve inlet port is fluidly isolated from the extend valve outlet port, and an open position, in which the extend valve inlet port is in fluid communication with the extend valve outlet port;

a retract poppet valve disposed within the retract valve bore and movable therein between a closed position, in which the retract inlet port is fluidly isolated from the retract valve outlet port, and an open position, in which the retract inlet port is in fluid communication with the retract valve outlet port;

an actuator including an actuator supply pressure port, an actuator return pressure port, an extend control pressure port, a retract control pressure port, a jet tube, and a three-channel torque motor, the actuator return pressure port in fluid communication with the extend valve return pressure port and the retract valve return pressure port, the extend control pressure port in fluid communication with the extend valve control pressure port, the retract control pressure port in fluid communication with the retract valve control pressure port, the jet tube in fluid communication with the actuator supply pressure port and movable to an extend position, a retract position, and a null position, the three-channel torque motor coupled to the jet tube and responsive to commands to move the jet tube;

a device housing having an inner surface, an outer surface, and at least one actuation control pressure port, the inner surface defining a device cavity, the at least one actuation control pressure port in fluid communication with the extend valve outlet port and the retract valve outlet port; and a device disposed at least partially in, and movable within, the device cavity, the device movable in response to at least fluid pressure in the at least one actuation control pressure port, wherein:

in the extend position, the actuator supply pressure port is in fluid communication with the extend valve control pressure port and the actuator return pressure port is in fluid communication with the retract valve control pressure port, thereby causing the extend poppet valve to be in its open position and the retract poppet valve to be in its closed position, in the retract position, the actuator supply pressure port is in fluid communication with the retract valve control pressure port and the actuator return pressure port is in fluid communication with the extend valve control pressure port, thereby causing the extend poppet valve to be in its closed position and the retract poppet valve to be in its open position, in the null position, the actuator supply pressure port and the actuator return pressure port are fluidly coupled to both of the extend valve control pressure port and the retract valve control pressure port, thereby causing the extend poppet valve to be in its closed position and the retract poppet valve to be in its closed position, and the torque motor moves the jet tube to, or causes it to remain in, the null position when electrical power is not supplied to the torque motor.

12. The system of claim 11, further comprising:

an extend valve spring disposed within the extend valve bore, the extend valve spring engaging the main body and the extend poppet valve and supplying a spring force to the extend poppet valve that urges the extend poppet valve toward its closed position; and a retract valve spring disposed within the retract valve bore, the retract valve spring engaging the main body and the retract poppet valve and supplying a spring force to the retract poppet valve that urges the retract poppet valve toward its closed position.

13. The system of claim 12, further comprising:

a second extend valve bore defined in the main body, the second extend valve bore including a second extend valve inlet port, a second extend valve outlet port, a second extend valve control pressure port, and a second extend valve return pressure port;

a second extend poppet valve disposed within the second extend valve bore and movable therein between a closed position, in which the second extend valve inlet port is fluidly isolated from the second extend valve outlet port, and an open position, in which the second extend valve inlet port is in fluid communication with the second extend valve outlet port;

a second retract valve bore defined in the main body, the second retract valve bore including a second retract valve inlet port, a second retract valve outlet port, a second retract valve control pressure port, and a second retract valve return pressure port; and a second retract poppet valve disposed within the second retract valve bore and movable therein between a closed position, in which the second retract inlet port is fluidly isolated from the second retract valve outlet port, and an open position, in which the second retract inlet port is in fluid communication with the second retract valve outlet port.

14. The system of claim 13, wherein:

in the extend position, the actuator supply pressure port is in fluid communication with the second extend valve control pressure port and the actuator return pressure port is in fluid communication with the second retract valve control pressure port, thereby causing the second extend poppet valve to be in its open position and the second retract poppet valve to be in its closed position, in the retract position, the actuator supply pressure port is in fluid communication with the second retract valve control pressure port and the actuator return pressure port is in fluid communication with the second extend valve control pressure port, thereby causing the second extend poppet valve to be in its closed position and the second retract poppet valve to be in its open position, and in the null position, the actuator supply pressure port and the actuator return pressure port are fluidly coupled to both of the second extend valve control pressure port and the second retract valve control pressure port, thereby causing the second extend poppet valve to be in its closed position and the second retract poppet valve to be in its closed position.

15. The system of claim 14, further comprising:

a second extend valve spring disposed within the second extend valve bore, the second extend valve spring engaging the main body and the second extend poppet valve and supplying a spring force to the second extend poppet valve that urges the second extend poppet valve toward its closed position; and a second retract valve spring disposed within the second retract valve bore, the second retract valve spring engaging the main body and the second retract poppet valve and supplying a spring force to the second retract poppet valve that urges the second retract poppet valve toward its closed position.

16. The system of claim 15, wherein:

the extend valve spring is disposed within an extend valve spring chamber that is defined between the main body and the extend poppet valve; and the retract valve spring is disposed within a retract valve spring chamber that is defined between the main body and the retract poppet valve;

the extend valve bore further includes a first auxiliary extend valve control pressure port and a second auxiliary extend valve control pressure port;

the first auxiliary extend valve control pressure port is (i) in continuous fluid communication with the second extend valve control pressure port, (ii) in fluid communication with the extend valve spring chamber when the extend poppet valve is in its closed position, and (iii) in fluid communication with the extend valve inlet and outlet ports and fluidly isolated from the extend valve spring chamber when the extend poppet valve is in its open position;

the second auxiliary extend valve control pressure port is (i) in continuous fluid communication with the second extend valve control pressure port (ii) in fluid communication with extend valve return pressure port and the extend valve spring chamber when the extend poppet valve is in its closed position, and (iii) in fluid communication with the extend valve inlet and outlet ports and fluidly isolated from the extend valve spring chamber when the extend poppet valve is in its open position;

the retract valve bore further includes a first auxiliary retract valve control pressure port and a second auxiliary retract valve control pressure port;

the first auxiliary retract valve control pressure port is (i) in continuous fluid communication with the second retract valve control pressure port, (ii) in fluid communication with the retract valve spring chamber when the retract poppet valve is in its closed position, and (iii) in fluid communication with the retract valve inlet and outlet ports and fluidly isolated from the retract valve spring chamber when the retract poppet valve is in its open position; and the second auxiliary retract valve control pressure port is (i) in continuous fluid communication with the second retract valve control pressure port (ii) in fluid communication with retract valve return pressure port and the retract valve spring chamber when the retract poppet valve is in its closed position, and (iii) in fluid communication with the retract valve inlet and outlet ports and fluidly isolated from the retract valve spring chamber when the extend poppet valve is in its open position.

17. The system of claim 13, wherein the actuator return pressure port is in fluid communication with the second extend valve return pressure port and the second retract valve return pressure port, the extend control pressure port is in fluid communication with second extend valve control pressure port, and the retract control pressure port in is fluid communication with second retract valve control pressure port.

* * * * *